United States Patent [19]

Hibi et al.

[11] Patent Number: 4,482,147

[45] Date of Patent: Nov. 13, 1984

[54] SHEET ARRANGING SYSTEM

[75] Inventors: Kunio Hibi, Yokohama; Tamaki Kaneko, Fujisawa; Sunao Ikeda, Yokohama; Tugio Okuzawa, Tokyo; Yohtaro Kakitani; Hideo Kikuchi, both of Yokohama, all of Japan

[73] Assignee: Ricoh Co., Ltd., Japan

[21] Appl. No.: 405,380

[22] Filed: Aug. 5, 1982

Related U.S. Application Data

[63] Continuation of Ser. No. 188,946, Sep. 19, 1980, abandoned.

[30] Foreign Application Priority Data

| | | | |
|---|---|---|---|
| Sep. 27, 1979 | [JP] | Japan | 54-133892[U] |
| Sep. 29, 1979 | [JP] | Japan | 54-134807[U] |
| Dec. 28, 1979 | [JP] | Japan | 54-181402[U] |

[51] Int. Cl.[3] ..... B65H 9/14

[52] U.S. Cl. ..... 271/229; 271/185; 271/251

[58] Field of Search ..... 271/225, 229, 240, 250, 271/251, 185

[56] References Cited

U.S. PATENT DOCUMENTS

| | | | |
|---|---|---|---|
| 1,291,089 | 1/1919 | Novick | 271/225 X |
| 2,617,647 | 11/1952 | Davis | 271/225 X |
| 3,980,296 | 9/1976 | Craft | 271/251 |
| 4,049,256 | 9/1977 | Church | 271/225 X |

*Primary Examiner*—Richard A. Schacher
*Attorney, Agent, or Firm*—McGlew and Tuttle

[57] ABSTRACT

A sheet arranging system for use with a sorter, collator, etc., providing a sheet arranging section defined by receiving rollers, delivery rollers and a forward reference edge, wherein sheets fed on the basis of rearward reference are moved toward a forward reference. The sheet arranging section has sheet obliquely moving means located therein for obliquely moving toward the delivery rollers and the forward reference edge the sheet released from the receiving rollers in accordance with the rearward reference irrespective of the size of the sheet, while so rotating the sheet that a corner of the leading edge of the sheet near to the operator is moved away from the forward reference edge.

3 Claims, 10 Drawing Figures

SHEET ARRANGING SYSTEM

This is a continuation of application Ser. No. 188,946 filed Sept. 19, 1980, and now abandoned.

BACKGROUND OF THE INVENTION

This invention relates to a sheet arranging system for use with a sorter, collator, etc., wherein sheets fed on the basis of a rearward reference are moved toward a forward reference edge disposed parallel to the direction of travel of the sheets, to arrange the sheets in accordance with the forward reference.

When copying is carried out by means of an electrophotographic copying apparatus, a method for placing an original in such a manner that its adjacent two sides are in abutting relation to front and side edges of contact glass is widely used because of the ease with which the operation can be performed. However, an image formed in the exposing step on a photosensitive member is reversed to the image of the original with respect to front and rear and left and right, so that the process steps following the exposing step are carried out in accordance with a rearward reference (as viewed from the operator) and copies are ejected from the copying apparatus in accordance with the rearward reference.

A sorter automatically classifies copies according to pages and is expected to have wide application in the future in offices for automation of office work which has hitherto been performed manually. A sorter includes a plurality of bins arranged in a plurality of layers in superposed relation for receiving copies therein. When copies are stacked in each bin in accordance with the rearward reference, difficulties are experienced for the operator to check them visually and retrive them therefrom, particularly when the copies are small in size, so that it is desirable to process the copies during the process of conveyance and arrange them in accordance with a forward reference.

To this end, it has hitherto been customary to provide an arranging section having a forward reference edge between the inlet rollers and intermediate rollers of the sorter, for example, wherein a copy forwarded in accordance with the rear reference is moved transversely or obliquely into contact with the forward reference edge and arranged in accordance with the forward reference. When a sheet is moved obliquely, the sheet may for some reason be pivotally rotated and makes a "head-on collision" or a corner of the leading edge of the sheet near to the operator may abut against the forward reference edge. When this is the case, the sheet may be bent or if the worst comes to the worst, may be rotated in such a manner that the leading edge of the sheet is disposed along the forward reference edge, due to the drive force of obliquely moving rollers, the force of friction produced between the corner of the sheet and the reference edge and the gravity of the sheet.

A sheet arranging system of the prior art that has been developed to cope with this situation is disclosed in Japanese patent application Laid-Open No. Sho-51-147326, for example, in which two sets of obliquely moving rollers are located parallel to the forward reference edge downstream of the receiving rollers, and the set of obliquely moving rollers nearer to the forward reference edge have a higher component of the peripheral velocity in the direction of regular sheet movement than the other set of obliquely moving rollers, to thereby prevent sheets from making a head-on collision with the forward reference edge irrespective of their size. This system has the disadvantages that they are large in the number of parts and the construction is complex.

Another system is known in which a sheet is placed on a belt mounted obliquely between the receiving rollers and delivery rollers of the arranging section, and the sheet is moved obliquely as it is released from the receiving rollers until one side of the sheet abuts against the forward reference edge when the sheet moves along the forward reference edge and nipped by the delivery rollers. In this system, a belt drive mechanism and other mechanisms of high expenses are used, thereby increasing cost.

A proposal has also been made to use a striking plate for striking a sheet at the rearward edge by the striking plate to cause the sheet to move into contact with the forward reference edge. The aforesaid striking of the sheet should be carried out after the sheet is released from the receiving rollers and before it is nipped by the delivery rollers, so that difficulties are encountered in moving the sheet in good timing.

SUMMARY OF THE INVENTION

This invention has been developed for the purpose of obviating the aforesaid disadvantages of the prior art. Accordingly, the invention has as its object the provision of a system for arranging sheets, simple in construction and low in cost, which is free from the danger of causing a sheet to make a head-on collision with the forward reference edge irrespective of the size of the sheets handled.

The foresaid object of the invention can be accomplished by providing, in a sheet arranging section defined by receiving rollers, delivery rollers and a forward reference edge, means for causing the sheet to move in obliquely rotational movement in such a manner that the corner of the leading edge of the sheet near to the operator is moved away from the forward reference edge as the sheet of the smallest size fed through the receiving rollers in accordance with the rearward reference is moved obliquely toward the forward reference edge and the delivery rollers.

In one embodiment, the means for causing the sheet to move in obliquely rotational movement comprises at least one obliquely moving roller located in the center of the sheet arranging section in a position in which the sheet of the smallest size released from the receiving rollers in accordance with the rearward reference is drawn and delivered to the delivery rollers in accordance with the forward reference. The sheet obliquely moving roller is located in a region defined by a straight line extending through the centers of gravity of sheets of various sizes at the time the sheets are released from the receiving rollers and disposed parallel to the sheet obliquely moving roller and the forward reference edge. By virtue of the relative positions of the line of action of the drive force of the sheet obliquely moving roller and the center of gravity of the sheet, the sheet released from the receiving rollers is moved obliquely toward the forward reference edge in a direction in which the corner of the leading edge of the sheet near to the operator is moved away from the forward reference edge, whereby a "head-on collision" of the sheet with the forward reference edge can be avoided and the sheet can be arranged in accordance with the forward reference.

Alternatively, in place of imparting moment of rotation to the sheet by utilizing the relative positions of the sheet obliquely moving roller and the center of gravity of the sheet, a limiting means for limiting the advance of the sheet may be provided between the sheet obliquely moving roller and the rearward reference, so as to thereby impart moment of rotation to the sheet and rotate same in a direction in which the sheet can avoid a "head-on collision" with the forward reference.

When the sheets handled are of a large size, such as a sheet of JIS B4 size (26 cm × 36 cm), leading and trailing end portions of the sheet remote from the center thereof at which the sheet is supported by the sheet obliquely moving roller may sag due to weight and quality of the sheet and come into contact with the lower guide plate to produce a frictional drag thereon, or the sheet may be prevented from moving forwardly because of the drive force of the sheet obliquely moving roller alone is not enough to convey the sheet of heavy weight. To avoid these phenomenons, an auxiliary roller may be provided in a position between the sheet obliquely moving roller and the rearward reference in which the auxiliary roller is maintained in contact with the sheet at all times at least a sheet of a large size released from the receiving rollers in accordance with the rearward reference is nipped by the delivery rollers in accordance with the forward reference. The auxiliary roller is advantageously rotated at a peripheral velocity which is slightly lower than a component of a peripheral velocity of the sheet obliquely moving roller directed in a regular sheet moving direction, to avoid a "head-on collision".

By virtue of the aforesaid construction, sheets of various sizes can be brought into contact with the forward reference edge by enabling each sheet to avoid coming into a "head-on collision" with the forward reference edge in arranging the sheets in accordance with the forward reference. Thus the sheets can be positively conveyed until they are nipped by the delivery rollers. The invention has the effects of increasing operation efficiency and reducing cost.

DESCRIPTION OF THE PREFERRED EMBODIMENTS

Figure 1:
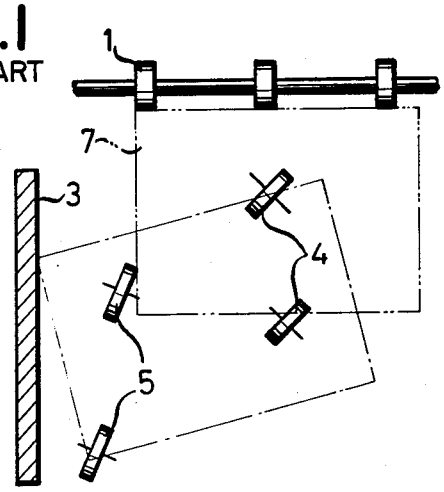
FIG.1 PRIOR ART
FIG. 1 is a plan view of a system for arranging sheets of the prior art.

Before describing preferred embodiment of the invention, the system of the prior art disclosed in Japanese patent application Laid-Open No. Sho-51-147326 will be outlined by referrring to FIG. 1. The system comprises receiving rollers 1, first sheet obliquely moving rollers 4 disposed at an angle of 45 degrees with respect to the receiving rollers 1, and second sheet obliquely moving rollers 5 interposed between the first sheet obliquely moving rollers 4 and a forward reference edge 3. By rotating the second sheet obliquely moving rollers 5 at a higher component of the peripheral velocity in the direction of regular sheet movement than the first sheet obliquely moving rollers 4, head-on collision of a sheet 7 with the forward reference edge 3 is alleged to be avoided, irrespective of the size of the sheet 7.

Figure 2:
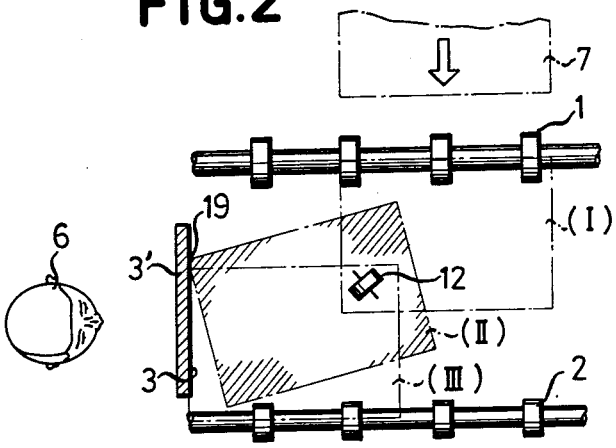
FIG. 2 is a plan view of the sheet arranging system comprising one embodiment of the invention.
Figure 3:
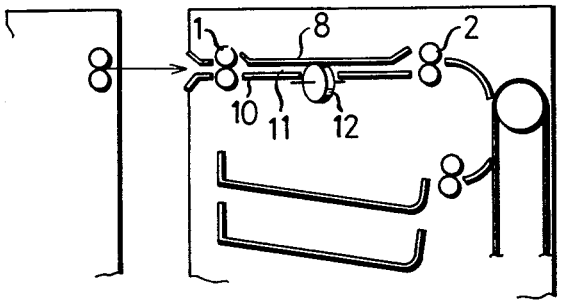
FIG. 3 is a sectional view of a collator incorporating therein the sheet arranging system according to the invention shown in FIG. 2.
Figure 4:
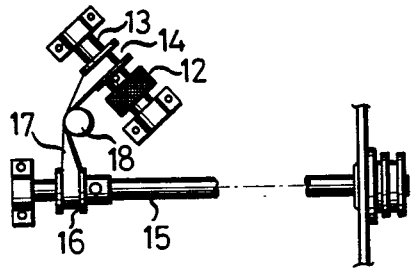
FIG. 4 is a plan view of the sheet obliquely moving roller drive means of the sheet arranging system shown in FIG. 2.
Figure 5:
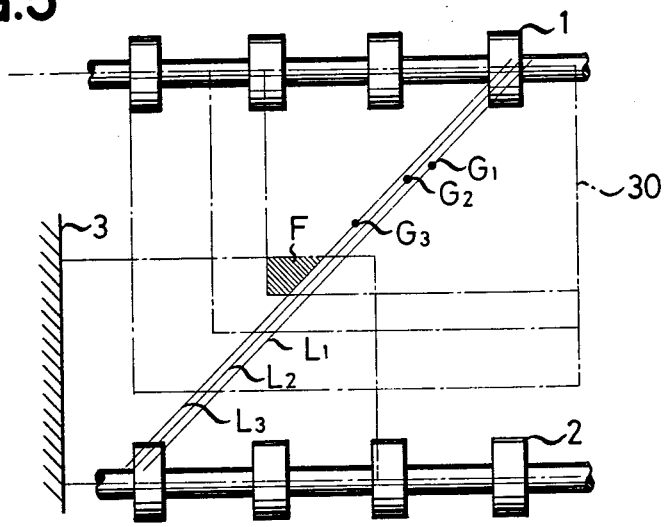
FIG. 5 is a plan view defining the region in which the sheet obliquely moving roller of the sheet arranging system shown in FIG. 2 is mounted.

FIGS. 2 and 3 show a first embodiment of the invention comprises receiving rollers 1 rotating at a predetermined velocity, delivery rollers 2 rotating at a predetermined velocity, and a block 3' having a forward reference edge 3 oriented in the direction of movement of a sheet 7 and disposed near the operator 6, the block 3' being secured to a lower guide plate 10. A sheet obliquely moving roller 12 rotatably supported by the lower guide plate 10 is located substantially in the center of a sheet arranging section 11 defined by the aforesaid parts at an angle of 45 degrees with respect to the regular direction of movement of the sheets in such a manner that the roller 12 is maintained in contact with an upper guide plate 8 hinged at one edge thereof to a machine frame. The sheet obliquely moving roller 12 is formed of a resilient foamed material in the form of a sponge, and driven, as shown in FIG. 4, through a belt 17 trained over a pulley 14 secured to a shaft 13 of the roller 12 and a pulley 16 secured to a drive shaft 15, with the belt 17 being forcedly in contact with an idler 18. A component of the peripheral velocity of the roller 12 in the direction of regular movement of the sheet is substantially equal to the peripheral velocity of the receiving rollers 1 and delivery rollers 2 ( or the peripheral velocity of the roller 12 is $\sqrt{2}$ times the peripheral velocity of the receiving rollers and delivery rollers). The sheet obliquely moving roller 12 is mounted in a position which, as shown in FIG. 5, is located in a region F enabling a sheet of the minimum size fed to the sheet arranging section 11 by the receiving rollers 1 in accordance with a rearward reference shown at 30 to be drawn and introduced into the delivery rollers 2 in accordance with the forward reference and interposed between the forward reference edge 3 and straight lines $L_1$, $L_2$ and $L_3$ extending through the centers of gravity $G_1$, $G_2$ and $G_3$ of sheets of different sizes at the time the sheets are released from the receiving rollers 1 in accordance with the rearward reference and disposed parallel to the direction in which the roller 12 is obliquely disposed.

In the system of the aforesaid construction, the sheet 7 ejected from the copying apparatus in accordance with the rearward reference is moved by the receiving rollers 1 to the sheet arranging section 11 in accordance with the rearward reference and placed on the sheet obliquely moving roller 12. Until the sheet 7 is released from the receiving rollers 1, the sheet 7 moves straight on the roller 12 pressed by the upper guide plate 8 while slipping. At this time, the sheet 7 is prevented from being slackened because a component of the peripheral velocity of the roller 12 in the direction of regular movement of the sheet 7 is substantially equal to the peripheral velocity of the receiving rollers 1. As the sheet 7 is released from the receiving rollers 1, the sheet 7 is not restrained on left and right thereof and rotated counterclockwise from a position (I) in FIG. 2 while moving obliquely at an angle of 45 degrees to a position (II) in which one corner 19 of the trailing edge of the sheet 7 abuts against the forward reference edge 3, so that the sheet 7 is placed in a tail-end collision condition. The counterclockwise rotation of the sheet 7 from position (I) to position (II) is caused by the relative positions of the line of action of the force driving the roller 12 and the center of gravity of the sheet 7. After the corner 19 of the sheet 7 has abutted against the forward reference edge 3, the sheet 7 pivoted at 19 is rotated clockwise by the drive force of the roller 12 so that the entire side edge of the sheet 7 is arranged in accordance with the forward reference and moved forwardly into the delivery rollers 2, to be delivered to the next processing step. In the event of the occurrence of a sheet jam in the sheet arranging section 11, the upper guide plate 8 can be pivotally opened by virtue of its hinged connection to the machine frame, to remove the sheet jam.

Figure 6:
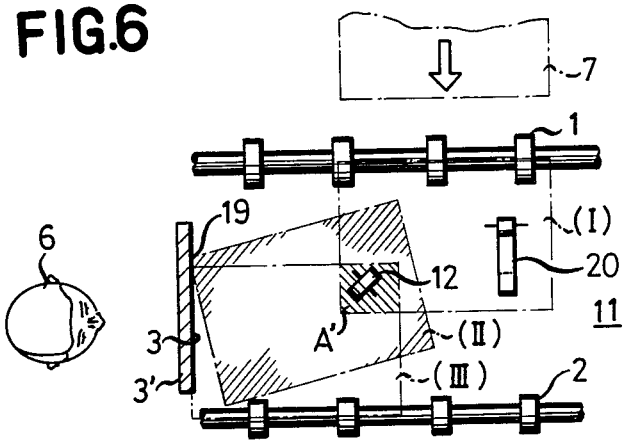
FIG. 6 is a plan view of the sheet arranging system comprising a second embodiment of the invention.
Figure 7:
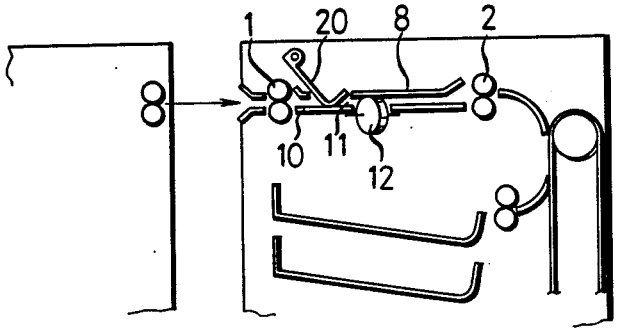
FIG. 7 is a sectional view of a collator incorporating therein the sheet arranging system shown in FIG. 6.

A second embodiment is shown in FIGS. 6 and 7 wherein the sheet obliquely moving roller 12 formed of a resilient foamed material and rotatively supported by the lower guide plate 10 by forming an angle of about 45 degrees with respect to the direction of regular movement of the sheet while being maintained in contact with the upper guide plate 8 is located, as in the first embodiment, substantially in the center of the arranging section 11 surrounded on three sides by the receiving rollers 1, delivery rollers 2 and forward reference edge 3. The sheet obliquely moving roller 12 rotates at a peripheral velocity which is about $\sqrt{2}$ times the peripheral velocity of the receiving rollers 1 and delivery rollers 2 and a component of the peripheral velocity of the roller 12 in the regular direction of movement of the sheet 7 is substantially equal to the peripheral velocity of the receiving rollers 1 and delivery rollers 2, as in the first embodiment. The second embodiment comprises, in addition to the parts described with reference to the first embodiment, a braking member 20 comprising a plate spring maintained in contact with the surface of the lower guide plate 10 with a suitable degree of pressing force.

In operation, the sheet 7 introduced into the sheet arranging section 11 in accordance with the rearward reference by the receiving rollers 1 is placed on the sheet obliquely moving roller 12 and reaches a position in which it is pressed by the braking means 20. However, since the direction of movement of the sheet 7 is regulated by the receiving rollers 1 until the sheet 7 is released from the receiving rollers 1, the sheet 7 slips relative to the roller 12 and braking member 20 and advances straight in the direction of movement thereof. At this time, a component of the peripheral velocity of the roller 12 in the direction of regular movement of the sheet 7 is substantially equal to the peripheral velocity of the receiving rollers 1, so that slackening or undulating of the sheet is avoided.

As the sheet 7 reaches position (I) shown in FIG. 6 and is released from the receiving rollers 1, the sheet 7 is moved obliquely by the sheet obliquely moving roller 12 because no restraint is placed on the sheet 7 with regard to its leftward or rightward movement or rotational movement. At this time, the sheet 7 is pressed with a relatively low force by the braking member 20 at a point displaced toward the rearward reference from the position of the roller 12, so that the sheet 7 is rotated counterclockwise in FIG. 6 while being moved obliquely by the roller 12. After being released from the braking member 20, the sheet 7 moved obliquely to position (II) in which the corner 19 of the trailing edge of the sheet 7 first abuts against the forward reference edge 3, to place the sheet 7 in a tail-end collision condition. Thereafter, the sheet 7 pivoted at 19 is rotated clockwise by the drive force of the roller 12 until the entire side edge is aligned with the forward reference edge 3. Thus the sheet 7 arranged in accordance with the forward reference is inserted into the delivery rollers 2, from which it is delivered to the next following processing step. The braking member 20 has been shown and described as being a plate spring maintained in contact with the surface of the lower guide plate 10 with a suitable degree of pressing force. However, the invention is not limited to this arrangement of the plate spring, and the plate spring may be in contact with the undersurface of the upper guide plate 8 in place of the surface of the lower guide plate 10. Also, the plate spring may be replaced by a coil spring, etc., serving as a braking member.

In the first and second embodiments, the sheet obliquely moving roller 12 has been described as being inclined by about 45 degrees with respect to the direction of regular movement of the sheet 7. It is to be understood that the invention is not limited to this specific value of the degree and that the inclination of the sheet obliquely moving roller 12 with respect to the direction of movement of the sheet 7 may have any value which suits the length of the sheet arranging section 11.

The sheet arranging section 11 has been described as being interposed between the receiving rollers 1 and intermediate rollers of the collator. However, the location of the sheet arranging section 11 may be in any suitable position along the path of movement of the sheet 7 from the copying apparatus to the collator, within an exit port of the copying apparatus or intermediate between the copying apparatus and the collator.

Figure 8:
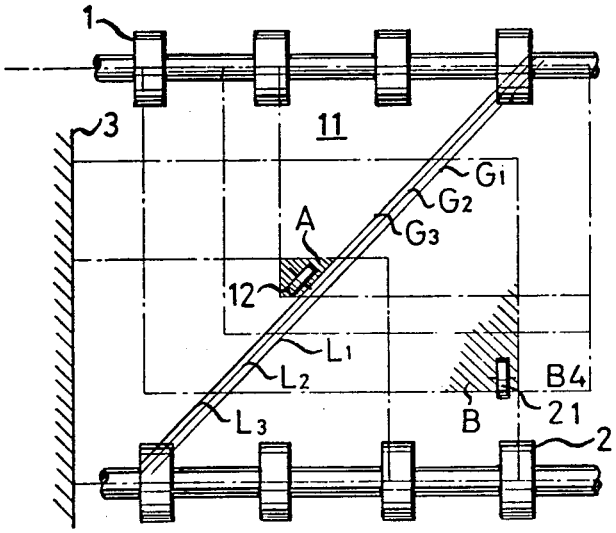
FIG. 8 is a plan view of the sheet arranging system comprising a third embodiment of the invention.

A third embodiment of the invention which is suitable for hadling a sheet of a large size will be described by referring to FIG. 8. This embodiment comprises the obliquelly sheet moving roller 12 of the same type as described by referring to the first embodiment shown in FIGS. 2–4 which is located in a region A, and an auxiliary roller 21 operative to move the sheet in the normal direction of its movement parallel to the forward reference edge 3 which is located in a region B interposed between the sheet obliquely moving roller 12 and the rearward reference in which a sheet of a size too large for the roller 12 alone to move same is maintained in contact with the auxiliary roller 21 at all times from the time it is released from the receiving rollers 1 in accordance with the rearward reference until the time it is inserted in the delivery rollers 2 in accordance with the forward reference. The peripheral velocity of the auxiliary roller 21 is slightly lower than component of the peripheral velocity of the sheet obliquely moving roller 12 in the direction of regular movement of the sheet 7.

In the third embodiment of the aforesaid construction, a sheet 7 of a large size introduced into the sheet arranging section 11 from the receiving rollers 1 in accordance with the rearward reference is supported by the sheet obliquely moving roller 12 and auxiliary roller 21 and driven both in an oblique direction and in the regular sheet moving direction. By this arrangement, frictional dragging of the sheet 7 on the guide plate occurring as a sagging front or rear end of the sheet 7 is brought into contact with the guide plate, a deficiency in the force for moving the sheet and other trouble inherent in sheets of a large size can be eliminated. The auxiliary roller 21 which is intended to obtain smooth movement in the sheet arranging section 11 of a sheet of a large size for which the moving force of the roller 12 alone is not enough to achieve satisfactory movement thereof may be advantageously located in a position in which the auxiliary roller 21 supported the sheet of a large size at one end portion thereof. More specifically, such position may be selected in a lower right corner of region B in FIG. 8.

As aforesaid, the auxiliary roller 21 has a peripheral velocity slightly lower than the component of the peripheral velocity of the sheet obliquely moving roller 12 in the direction of regular movement of the sheet. By being supported by the two rollers 12 and 21, the sheet is positively rotated counterclockwise as it is moved obliquely, and brought into abutting engagement with the forward reference end 3 in a condition of tail-end collision. Even after the entire side edge of the sheet is aligned with the forward reference edge 3, a force tending to rotate the sheet counterclockwise is suitably exerted on the sheet to thereby avoid clockwise rotation of the sheet about a corner of the leading edge thereof.

Figure 9:
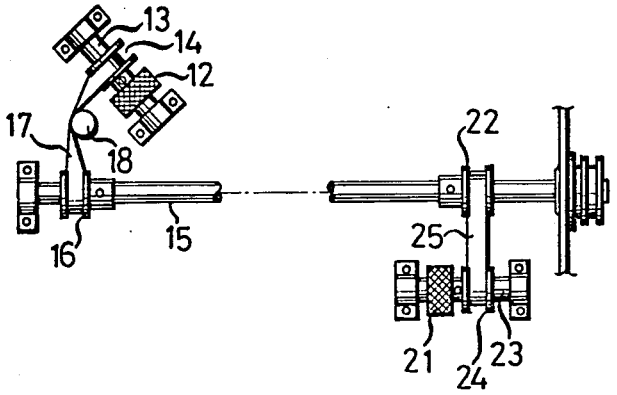
FIG. 9 is a plan view of the drive means for the sheet obliquely moving roller and auxiliary roller of the sheet arranging system shown in FIG. 9.

As shown in FIG. 9, the sheet obliquely moving roller 12 and auxiliary roller 21 are driven by belts 17 and 25 trained over a pulley 16 mounted on a drive shaft and a pulley 14 mounted on a shaft 13 supporting the roller 12 and over a pulley 22 mounted on the drive shaft 15 and a pulley 24 mounted on a shaft 23 supporting the auxiliary roller 21 respectively. By setting the ratio of the diameters of the pulleys at a suitable value, it is possible to give to the auxiliary roller 21 a peripheral velocity which is slightly lower than the component of the peripheral velocity of the sheet obliquely moving roller 12 in the regular direction of movement of the sheet.

Figure 10:
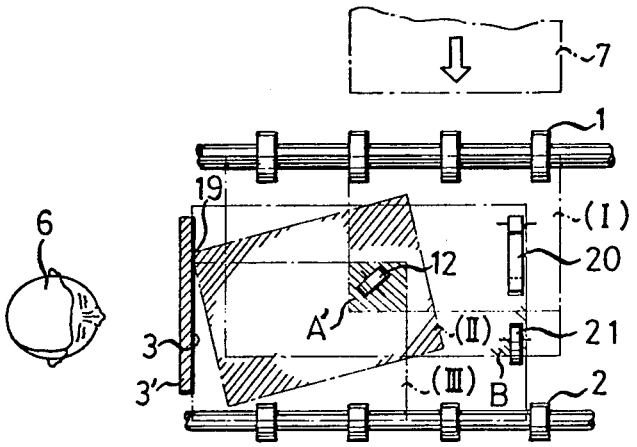
FIG. 10 is a plan view of the sheet arranging system comprising a fourth embodiment of the invention.

FIG. 10 shows a fourth embodiment of the invention in which, as can be seen in the figure, the auxiliary roller 21 for enabling a sheet of a large size to be positively moved is mounted in region B in the same manner as described by referring to the third embodiment in addition to the construction of the second embodiment described by referring to FIGS. 6 and 7.

The fourth embodiment operates in the same manner as the third embodiment, so that the description thereof will be omitted.

What is claimed is:

1. A sheet arranging system comprising:

receiving rollers (1) for receiving and feeding a sheet in a feed direction with a rear edge of the sheet aligned with a rearward reference (30), the sheet having a width between a narrowest and a broadest dimension and having a center of gravity;

delivery rollers (2) for delivering the sheet in the feed direction with a front edge of the sheet aligned with a forward reference, said receiving and delivering rollers being spaced apart in the feed direction by an amount which is less than twice the narrowest dimension of a sheet to be fed in the feed direction so that an area of overlap (F) exists between the sheet as it leaves the receiving rollers and as it enters the delivery rollers, the delivery rollers being distributed over more than the broadest dimension;

a forward reference edge (3) interposed between said receiving rollers and said delivery rollers and extending parallel; to the feed direction;

only one sheet moving roller (12) mounted for rotation at an acute angle to the feed direction between said receiving and delivery rollers and in said area of overlap (F) for receiving the sheet from said receiving rollers and introducing the same sheet to said delivery rollers, said sheet moving roller also disposed between said forward reference edge (3) and a straight line extending through the center of gravity of a sheet to be fed at the time the sheet to be fed is released from the receiving rollers, said straight line being parallel to said acute angle;

drive means connected to said sheet moving roller for rotating said sheet moving roller so that the sheet to be fed is rotated to engage a trailing edge thereof adjacent said forward reference edge, against said forward edge before any other part of the sheet engages said forward reference edge; and a braking member (20) in the vicinity of the rearward reference and upstream of said sheet moving roller in the feed direction for braking movement of a sheet in the feed direction adjacent the rearward reference.

2. A sheet arranging system comprising:

receiving rollers (1) for receiving and feeding a sheet in a feed direction with a rear edge of the sheet aligned with a rearward reference (30), the sheet having a width between a narrowest and a broadest dimension and having a center of gravity;

delivery rollers (2) for delivering the sheet in the feed direction with a front edge of the sheet aligned with a forward reference (3), said receiving and delivering rollers being spaced apart in the feed direction by an amount which is less than twice the narrowest dimension of a sheet to be fed in the feed direction so that an area of overlap (F) exists between the sheet as it leaves the receiving rollers and as it enters the delivery rollers, the delivery rollers being distributed more than the broadest dimension;

a forward reference edge (3) interposed between said receiving rollers and said delivery rollers and extending parallel to the feed direction;

only one sheet moving roller (12) mounted for rotation at an acute angle to the feed direction between said receiving and delivery rollers and in said area of overlap (F) for receiving the sheet from said receiving rollers and introducing the same sheet to said delivery rollers, said sheet moving rollers also disposed between said forward reference edge (3) and a straight line extending through the center of gravity of a sheet to be fed at the time the sheet to be fed is released from the receiving rollers, said straight line being parallel to said acute angle; and drive means connected to said sheet moving roller for rotating said sheet moving roller so that the sheet to be fed is rotated to engage a trailing edge thereof adjacent said forward reference edge, against said forward reference edge before any other part of the sheet engages said forward reference edge;

said acute angle being about 45°; and an auxiliary roller (21) for producing a force of movement in the feed direction for large sheets positioned adjacent the rearward reference and downstream of said sheet moving roller in the feed direction.

3. A sheet arrangement according to claim 2, including a braking member (20) in the vicinity of the rearward reference and upstream of said sheet moving roller in the feed direction for braking movement of a sheet in the feed direction adjacent the rearward reference.

* * * * *